US005361576A

United States Patent [19]

Müller

[11] Patent Number: 5,361,576

[45] Date of Patent: Nov. 8, 1994

[54] METHOD FOR OPERATING A COMBUSTION CHAMBER OF A GAS TURBINE

[75] Inventor: Gerhard Müller, Wettingen, Switzerland

[73] Assignee: Asea Brown Boveri Ltd., Baden, Switzerland

[21] Appl. No.: 59,992

[22] Filed: May 12, 1993

[30] Foreign Application Priority Data

May 27, 1992 [CH] Switzerland ..... 1715/92

[51] Int. Cl.[5] ..... F02C 9/28

[52] U.S. Cl. ..... 60/39.03; 60/39.06; 60/747

[58] Field of Search ..... 60/39.03, 39.06, 746, 60/747, 737, 738, 734, 739

[56] References Cited

U.S. PATENT DOCUMENTS 4,027,473 6/1977 Baker ..... 60/739
4,408,461 10/1983 Bruhwiler ..... 60/747

FOREIGN PATENT DOCUMENTS 0381079 6/1990 European Pat. Off. ..... 60/747
0321809B1 5/1991 European Pat. Off. .
1039785 9/1958 Germany .
2845588 4/1980 Germany .
0135942 6/1986 Japan ..... 60/746
0187540 8/1986 Japan ..... 60/39.06
2239056 6/1991 United Kingdom ..... 60/739

*Primary Examiner*—Richard E. Gluck
*Assistant Examiner*—William Wicker
*Attorney, Agent, or Firm*—Burns, Doane, Swecker & Mathis

[57] ABSTRACT

In a method for operating a silo combustion chamber (A) of a gas turbine, this combustion chamber is equipped with a number of premixing burners (B), these burners being arranged so that they are subdivided in groups within the combustion chamber (A). At least one group is equipped with controllable premixing burners. Very high demands are made on the quality of the combustion during the operation of such a combustion chamber (A), particularly in the full-load range, in order to meet the stringent $NO_x$ emission regulations. For this purpose, the last group to be switched on is controlled at full load in accordance with the ambient conditions. A load control system also acts at part load. By this means, it is possible to prevent a fluctuation of the $NO_x$ emissions due to the varying ambient conditions.

2 Claims, 8 Drawing Sheets

METHOD FOR OPERATING A COMBUSTION CHAMBER OF A GAS TURBINE

BACKGROUND OF THE INVENTION

Field of the Invention

The present invention relates to a method for operating a combustion chamber. It also relates to the configuration of a burner for operating such a combustion chamber.

Discussion of Background

So-called silo combustion chambers are equipped with burners operating on the "lean premix principle". These so-called "dry low $NO_x$" burners are operated in accordance with a switching operation mode in which the burners are subdivided into relatively large burner groups. These burners themselves can be installed and operated in both silo combustion chamber and annular combustion chambers. Using an annular combustion chamber as an example, a row of premixing burners of different sizes are arranged at the inlet end and in the peripheral direction. The large premixing burners, which are the main burners of the combustion chamber, and the small premixing burners, which are the pilot burners of the combustion chamber, are positioned with outlet ends on a front wall of the combustion chamber; the premixing burners are arranged alternately and at a uniform distance from one another. In the case of the silo combustion chambers, the premixing burners provided are arranged in honeycomb fashion at the top end of the combustion chamber and are subdivided into groups which usually consist of one piloting burner and a plurality of piloted burners.

The burners are put into operation individually or in groups as a function of the load. A fuel distribution system includes a switching operation which permits individual burner groups to be switched on or off. The switching operation has the disadvantage that the burner equivalence numbers, and therefore the $NO_x$ emissions, vary greatly. In the case considered, the groups of burners are generally relatively large, by analogy with the known "dry low $NO_x$" technique. This is associated with the fact that an operating concept limited to a few groups offers advantages in terms of hardware and software complication. Various modes of operation can be proposed as a basis, such as one in which a valve position varies with the load, another in which the fuel distribution varies with the load or yet another in which the fuel allocation for each burner depends on the load ratio.

This procedure leads to the burner equivalence numbers, which are decisive for the $NO_x$ emissions, being subject to great fluctuations and, therefore, the $NO_x$ emissions also fluctuate strongly. In order to reduce these combustion fluctuations as to load varies, it would be conceivable to increase the number of groups. In the ideal case, this would lead to individual triggering for each burner. However, gas turbines of large output power require powerful combustion chambers with a correspondingly large number of burners, which in turn makes it necessary to install a large number of valves and supply conduits for the burners. The steps for switching the burners on or off would, in themselves, be minimal, but the number of valves and supply conduits would create substantial hardware and software complications. An additional factor in such a mode of operation is that it is difficult to deal with fluctuating ambient conditions so that, in the end, combustion fluctuations would still be expected, contrary to the objective of keeping the $NO_x$ emissions constant and low over the whole of the operation, and particularly at full load.

Summarizing, it may be stated that the following effects prevent the $NO_x$ emissions from being kept constant in the case of variable ambient conditions:

- the proportion of the air quantity induced which is used for cooling the turbine increases or falls with the ambient temperature (pressure) and the combustion chamber air quantity falls or rises reciprocally. Despite constant temperature, this leads to variable flame temperatures and, therefore, to varying production of $NO_x$; and,
- the change to the combustion chamber pressure because of the ambient conditions leads directly to a change in the formation of $NO_x$ in the combustion chamber.

SUMMARY OF THE INVENTION

Accordingly, one object of this invention is to provide an operating method for a combustion chamber of the type quoted at the beginning, which does not, in general, permit the $NO_x$ emissions to increase beyond the specified value due to fluctuating ambient conditions, particularly at full load.

Particularly in the case of a silo combustion chamber, in which a plurality of similar premixing burners are arranged as groups, very high demands are made on the quality of the combustion, particularly in the full-load range, in order to meet stringent $NO_x$ emission regulations. The principle of piloted operation of individual burners is used here as the basis of operation. The essential advantage of the invention may be seen in that, for this purpose, the last group of burners to be switched on is supplied with fuel as a function of, preferably, the ambient temperature. These burners are operated with a fundamentally weaker mixture than the other burners, for which reason they only participate to an unimportant extent in the production of the thermal $NO_x$ output. If the external temperature falls, a valve of this last group is opened further, which leads to a redistribution of the fuel from the $NO_x$-relevant pilot burners to the last group. When the external temperature rises, the reverse procedure occurs. The $NO_x$ formation can therefore be kept constant, although it should be immediately noted that zones of constant, stable combustion with uniform $NO_x$ production exist in the combustion chamber, as do small regions in which compensation is provided for the ambient temperature effects. These latter regions, however, scarcely contribute to the thermal $NO_x$ output.

A further essential advantage of the invention may be seen in that in addition to controlling constant $NO_x$ emissions at full load, it is also possible to maintain a constant operational margin from the burner blow-out limit at full load. This would lead to minimum possible $NO_x$ emissions in each case.

A further essential advantage of the invention is, furthermore, that the last burner group to De switched on in each case is controlled in accordance with the ambient conditions even at part load; there is a complementary control as a function of the load in this case.

Advantageous and expedient further developments of the solution according to the invention are claimed in the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
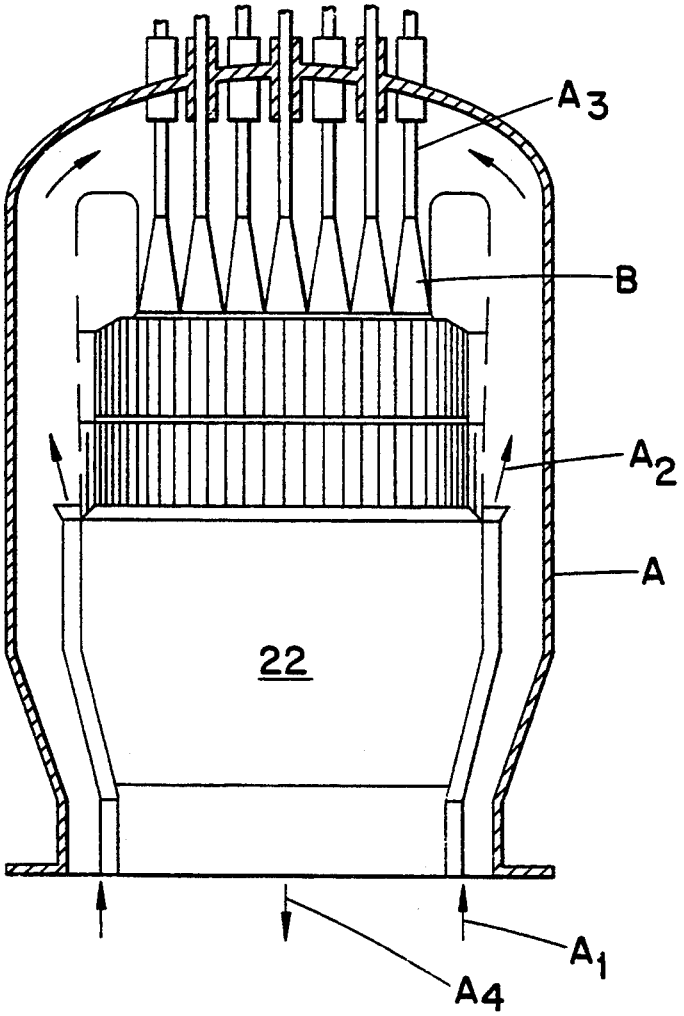
FIG. 1 is a front sectional view of a silo combustion chamber with premixing burners.

Referring now to the drawings, wherein like reference numerals designate identical or corresponding parts throughout the several views, the flow direction of the media is indicated by arrows and all the elements not necessary for direct understanding of the invention are omitted. FIG. 1 shows a typical silo combustion chamber A which is equipped with a plurality of premixing burners B. As a supplement for direct understanding of the mode of operation of this combustion chamber A, an indication is given of the introduction of the compressed air A1 from the compressor into the combustion chamber A, of the flow path A2 of this compressed air to the burners B, of the fuel supply A3 to the burners B, of the combustion space 22 of the combustion chamber A downstream of the burners B and of the hot gases A4 for admission to a turbine.

Figure 2:
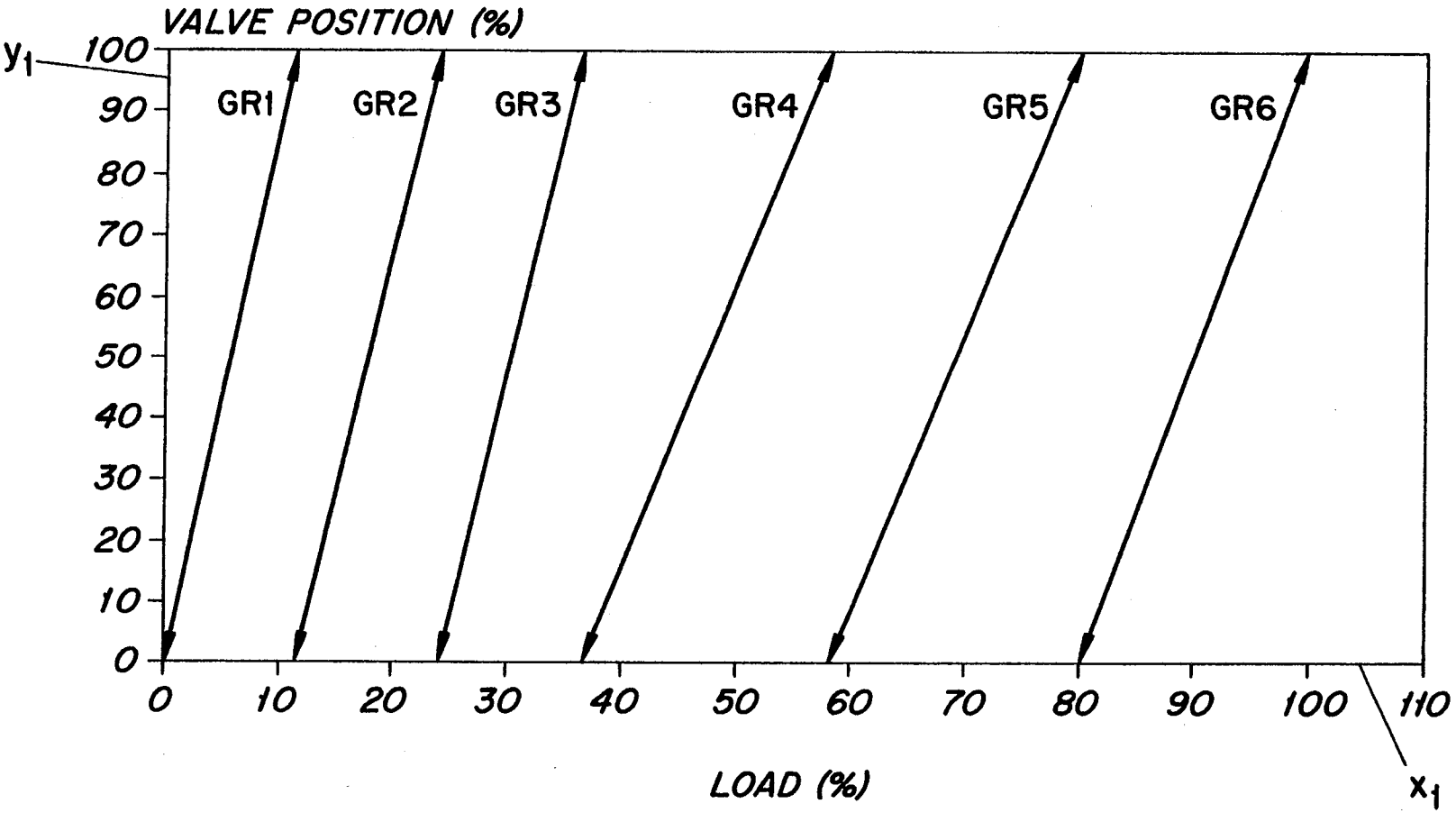
FIG. 2 is a diagram of a piloted operation, valve position plotted against load.
Figure 3:
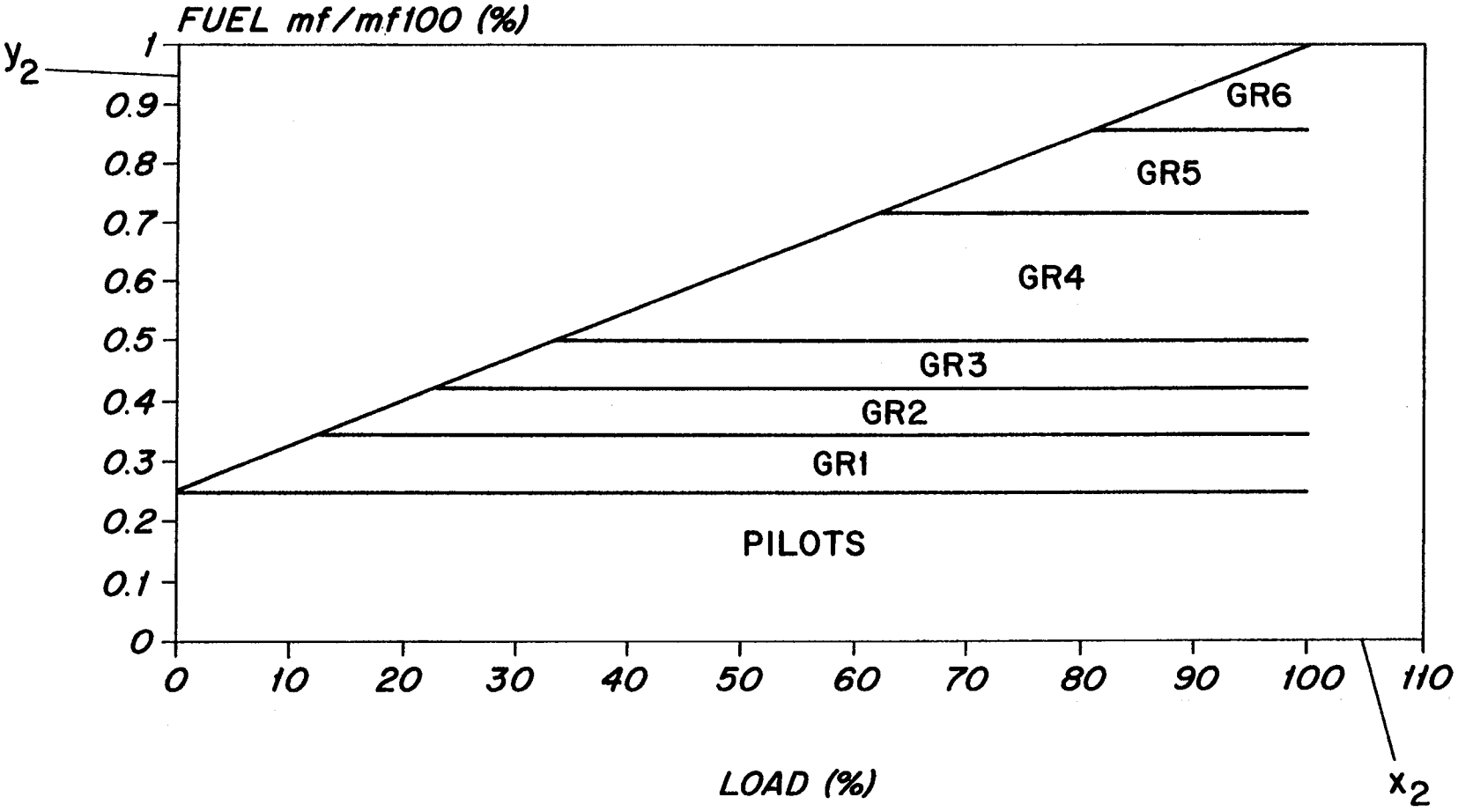
FIG. 3 is a diagram of a piloted operation, fuel quantity plotted against load.
Figure 4:
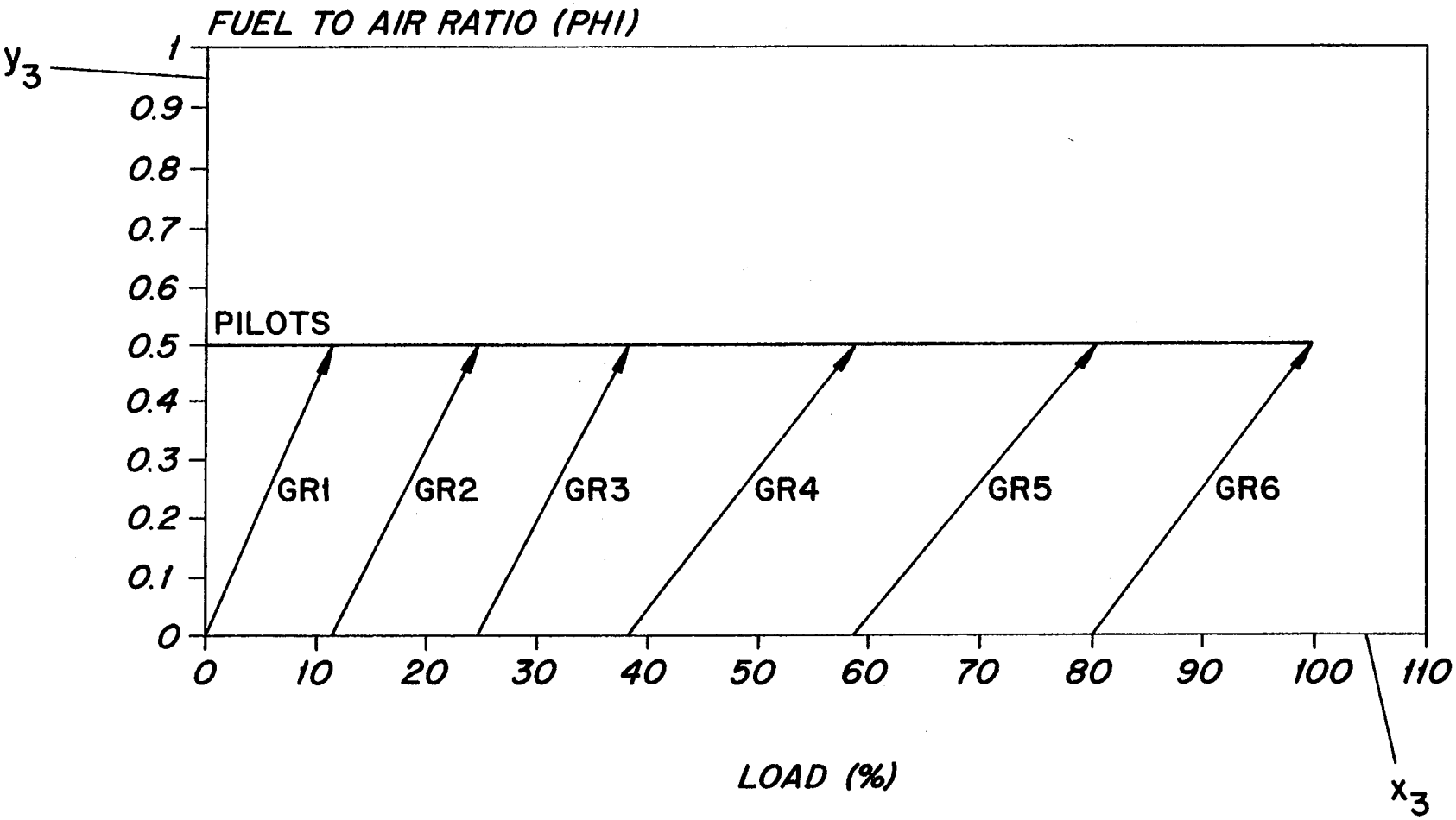
FIG. 4 is a diagram of a piloted operation, fuel/air ratio plotted against load.

FIGS. 2–4 are diagrams of a piloted operation with a plurality of burners which are combined into individual groups within the combustion chamber A. The behavior of various parameters is shown as a function of the load on the combustion chamber, the load being plotted on the abscissae X1, X2, X3 of the various figures mentioned. The various parameters are the valve position, plotted on the ordinate Y1 of FIG. 2, the fuel quantity, plotted on the ordinate Y2 of FIG. 3 and the fuel/air ratio, plotted on the ordinate Y3 of FIG. 4. These figures indicate how, in the piloted operation of burners, the $NO_x$ emissions can be kept constant over the load by keeping the combustion constant in the majority of burners B in the combustion chamber A and operating a small number of burners in piloted fashion. These burners are operated with a mixture so weak that they are below their blow-out limit and do not, therefore, have their own reaction zone. The piloted burners accommodate all the load changes. In this configuration, increased demands have to be made on the group valves (FIG. 2) because they must be fully controllable. The fuel (FIG. 3) of the piloted burners can only react if the arrangement and the swirl direction of the adjacent burners which are operating, lead to good mixing of the fuel/air mixture (FIG. 4) with the adjacent burners. The optimum arrangement in this case depends on the particular relationships of the combustion chamber and the number of burners. FIGS. 2–4 indicate, diagrammatically, how a 7-group operating program appears in the case of a total of 34 burners:

Pilot burner group GR0=6 burners
Main burner group GR1, GR2=3 burners each
Main burner group GR3=4 burners
Main burner group GR4, GR5, GR6=6 burners each In addition to the operating concept described for the individual groups, which may be clearly seen from FIGS. 2–4, the mode of operation of the last group GR6 is emphasized yet again. As already described above, the principle of piloted operation of individual burners offers, in itself, a possibility of compensating for the disadvantages which are present in the prior art and have been highlighted in the introduction to the description. In addition, the burners of the group 6, GR6, are now supplied with fuel as a function of the ambient temperature. These burners are basically operated with a weaker mixture than the burners of the other groups and logically, therefore, only participate to an unimportant extent in the production of the thermal $NO_x$ output. If, for example, the external temperature falls, the valve of group 6, GR6, is opened further, which leads to a redistribution of the fuel from the $NO_x$-relevant burners to the burners of the last-mentioned group 6, GR6. If, on the other hand, the external temperature rises, the reverse procedure occurs. The $NO_x$ formation can therefore be kept constant. In addition to controlling to constant $NO_x$ emissions at full load, it is also possible to maintain a constant operational margin from the burner blow-out limit at full load. This would then lead to minimizing the possible $NO_x$ emissions in each case.

Figure 5:
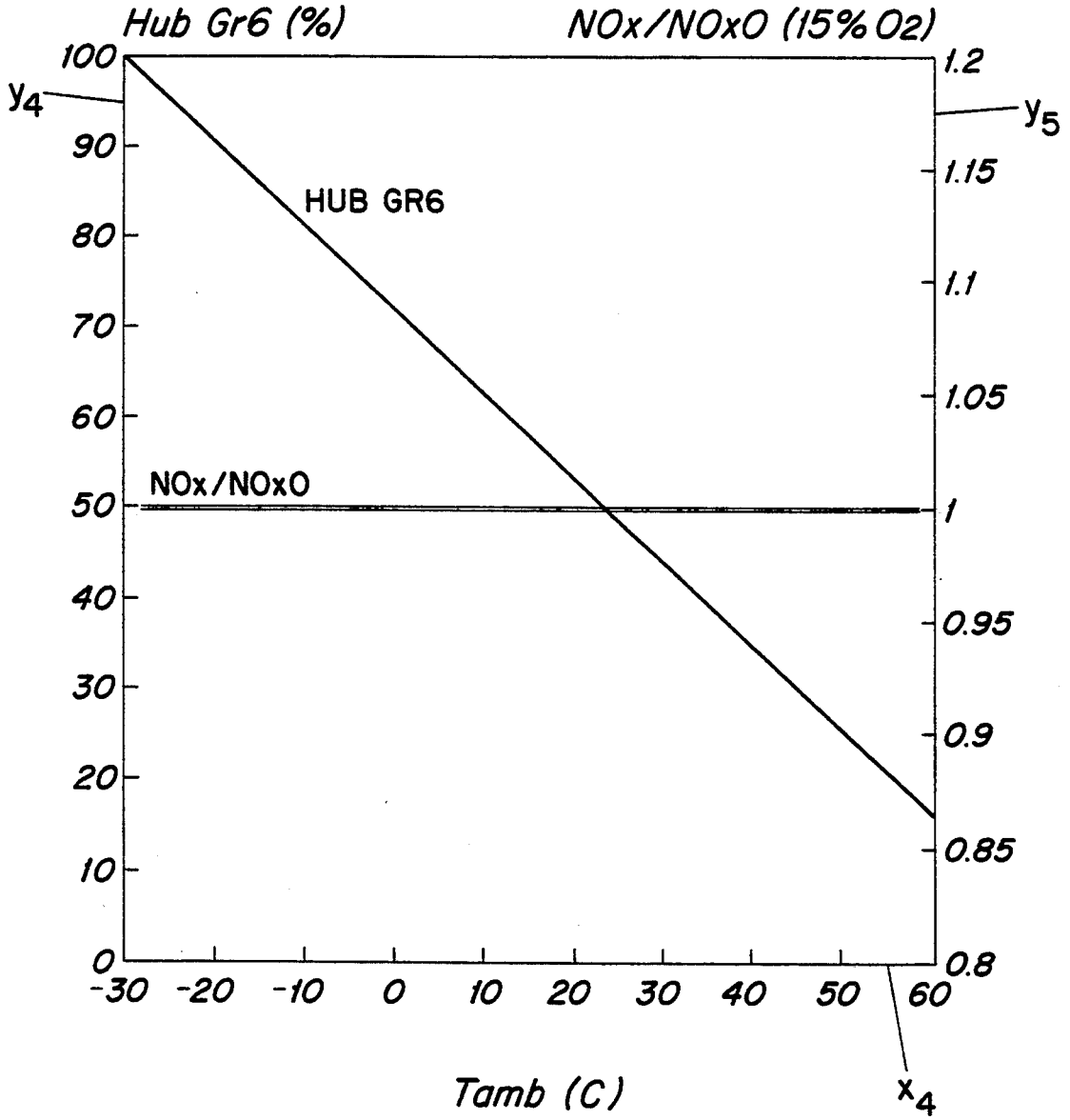
FIG. 5 is a diagram of a correction to the valve lift of the piloted last group, as a function of the ambient temperature at full load.

Referring to FIG. 5, the position of the valve of group 6, GR6, is shown plotted as the ordinate Y4 against the external temperature as the abscissa X4, at full load, the other ordinate Y5 representing the indexed $NO_x$ output.

Figure 6:
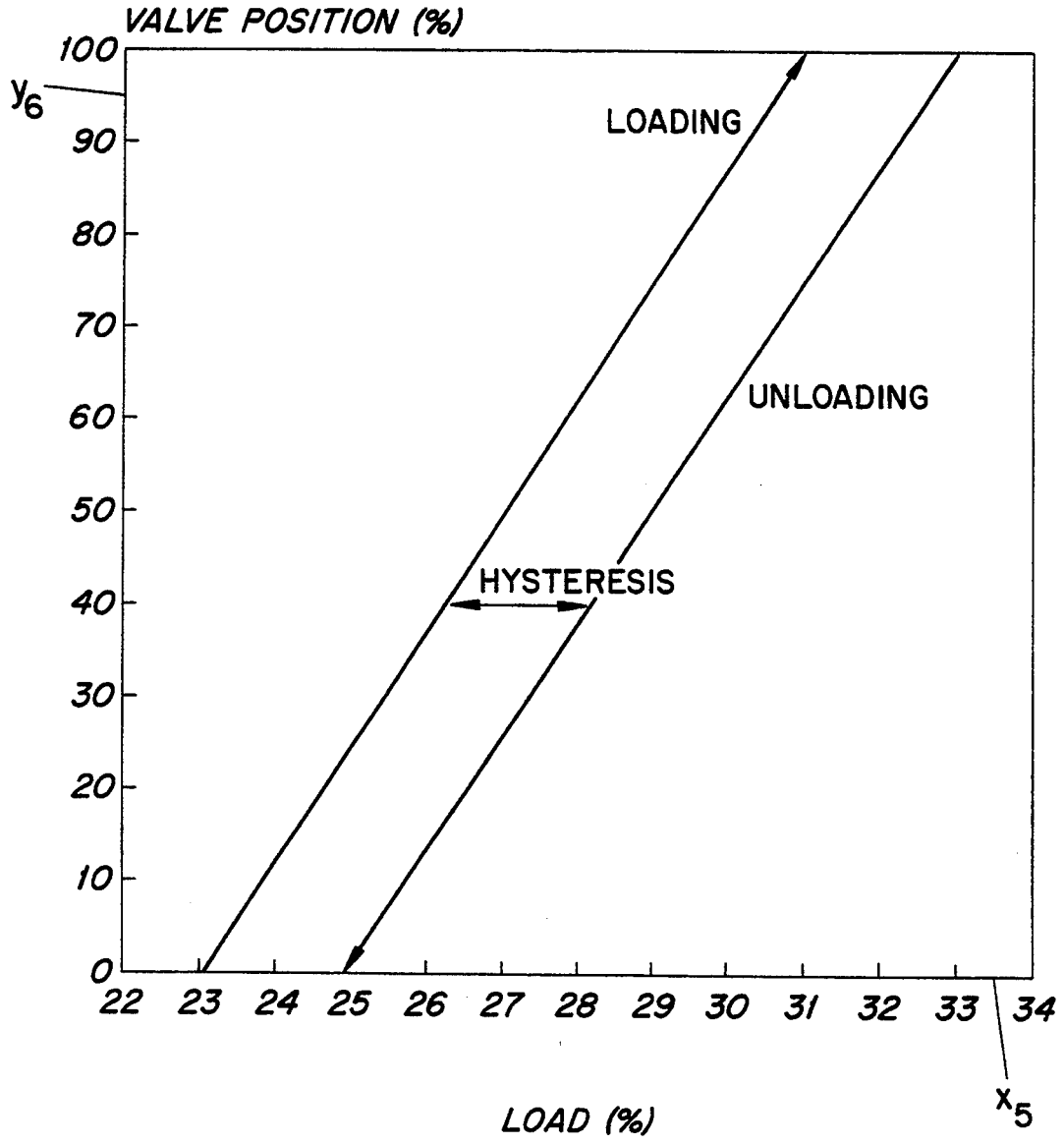
FIG. 6 is a diagram showing a hysteresis in the burner group control in piloted operation when the plant is being run up and run down.
Figure 7:
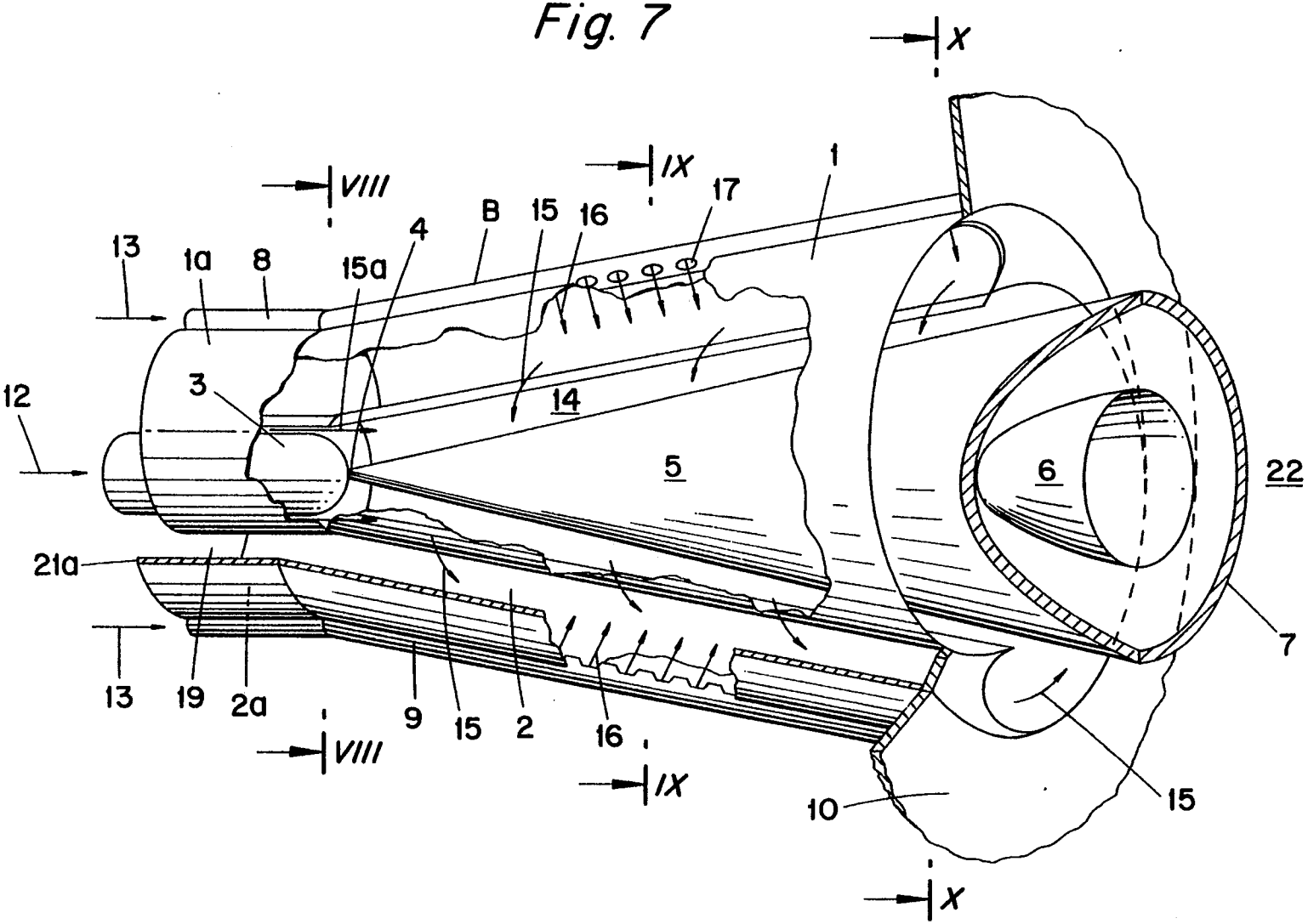
FIG. 7 is a partially sectioned view of a premixing burner.

Referring to FIG. 6, a piloted mode of operation makes it possible to operate the burners at the blowout limit, as shown. If, in the course of the operation one gas turbine of the gas turbine group is relieved of load, this leads to a slightly reduced fuel mass flow per load compared with steady-state operation. This, however, increases the danger that all the burners may exceed the blow-out limit. Aid is provided in this case by the hysteresis Z, implemented by the switching technique, of FIG. 6 (with the valve position as ordinate Y6 plotted against the load as the abscissa X5.) This shows that it is fundamentally easier and advantageous to operate the burners with a richer mixture when the load on the installation is being decreased than when the load output is being increased.

Figure 8:
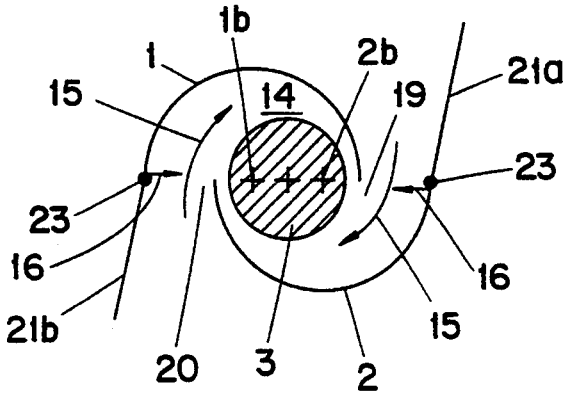
FIGS. 8–10 are corresponding sectional views through various planes of the burner of FIG. 7, in a diagrammatic representation.
Figure 9:
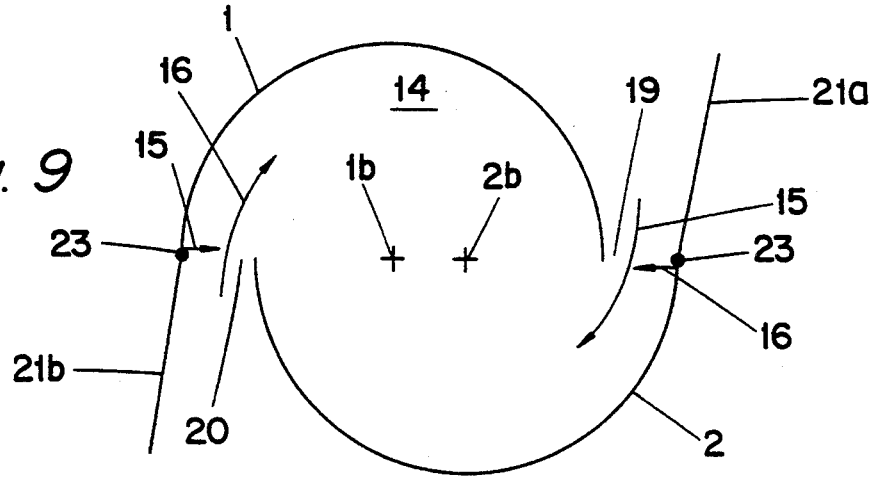
Figure 10:
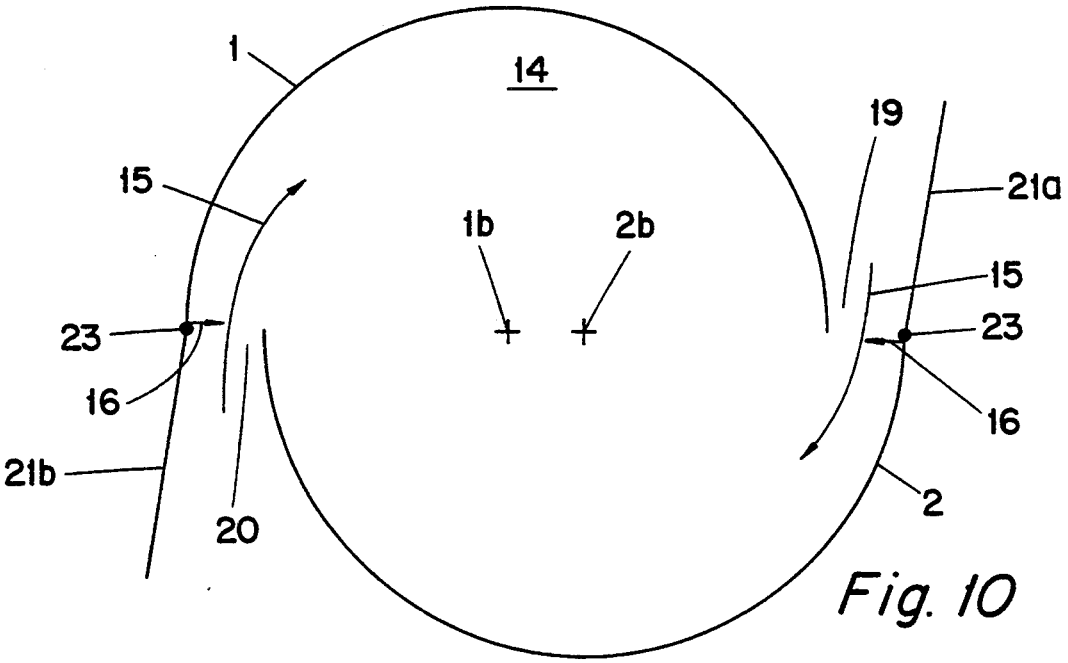

FIGS. 7–10 show a burner B employed for the piloted operation. This burner B can be either pilot burner of main burner, with a size selected specific to its purpose. For a better understanding of the construction of this burner B, it is advantageous to consider, simultaneously with FIG. 7, the individual sections of the burner shown in FIGS. 8–10. Furthermore, the guide plates **21*a*, 21*b* shown diagrammatically in FIGS. 8–10 are only included as indications so as to avoid making FIG. 7 unnecessarily difficult to understand. In what follows, reference is made as required to the other FIGS. 8–10 in the description of FIG. 7. Burner B shown in FIG. 7 consists of two half hollow conical bodies 1, 2 which are located adjacent one another to form a conical interior space 14 and radially offset relative to one another with respect to their center lines 1***b*, 2*b* (FIGS. 8–10). The offset of the respective center lines 1*b*, 2*b* relative to one another frees a tangential air inlet slot 19, 20 on each of the two sides of the bodies 1, 2 in an opposing inlet flow arrangement (on this point, see FIGS. 8–10). The combustion air 15, which consists, for example, of fresh air and recirculated exhaust gas, flows through the air inlet slows 19, 20 into the internal space 14 of the burner B. The conical shape in the flow direction of the bodies 1, 2 shown has a certain constant angle. The bodies 1, 2 can of course have a progressive or degressive conical inclination in the flow direction. The latter embodiments are not shown in the drawing because they can be imagined without difficulty. The shape which is finally given preference depends essentially on the parameters exhibited by the particular combustion. The two bodies 1, 2 each have a cylindrical initial part 1*a*, 2*a* which forms a natural continuation of the conical shape and therefore also have tangential inlet slots. A nozzle 3 is accommodated in the region of this cylindrical initial part 1*a*, 2*a* when the premixing burner B is operated with a liquid fuel 12 and the fuel injection point 4 from this nozzle 3 coincides approximately with the narrowest cross-section of the hollow conical space 14 formed by the bodies 1, 2. The fuel output of this nozzle 3 depends on the power and size of the burner. It is, of course, possible to omit the cylindrical initial parts 1*a*, 2*a*. Each of the two bodies 1, 2 includes a fuel conduit 8, 9 when the premixing burner B is operated with a gaseous fuel 13 and the conduit 8, 9 has a number of regularly distributed openings 17 along the length of the burner B in the flow direction. These openings are preferably configured as nozzles. A gaseous fuel 13 is therefore introduced through these openings 17 and is mixed 16 into the combustion air 15 flowing through the tangential inlet slots 19, 20 into the hollow conical space 14. These fuel conduits 8, 9 are preferably placed at the end of the tangential inlet flow, directly in front of the inlet into the hollow conical space 14, this being done in order to achieve optimum velocity-induced mixing 16 between the fuel 13 and the entering combustion air. Mixed operation with different fuels is, of course, also possible by means of these openings 17. Fundamentally, the burner B is only provided with those fuel supply means intended for the particular fuel. At the combustion space end 22, the outlet opening of the burner B merges into a front wall 10 in which holes are provided (not however shown in the drawing) through which dilution air, cooling air and/or combustion air flows if required and, by this means, advantageously influences the flame region. The liquid fuel 12 flowing out of the nozzle 3 is injected at an acute angle into the hollow conical space 14 in such a way that a conical spray 5, which is as homogeneous as possible forms at the burner outlet plane. This is only possible if the inner walls of the bodies 1, 2 are not wetted by this fuel. This nozzle 3 is preferably an air-supported nozzle or a nozzle with pressure atomization. The conical fuel spray 5 from the nozzle 3 is enclosed by the tangentially entering combustion air 15 and, if required, by a further axially introduced combustion airflow 15*a*. The concentration of the liquid fuel 12 is continually reduced in the axial direction by the combustion air 15 entering via the tangential inlet slots 19, 20. If gaseous fuel 13 is injected via the fuel conduits 8, 9, the formation of the mixture with the combustion air takes place, as already described above, directly in the region of the tangential inlet slots 19, 20. In association with the injection of the liquid fuel 12, the optimum homogeneous fuel concentration over the cross-section is achieved in the region of the vortex breakdown, i.e. in the region of a reverse flow zone 6 forming at the outlet from the burner B. The ignition takes place at the tip of the reverse flow zone 6. It is only at this position that a stable flame front 7 can occur.

In this case, there is no need to fear flashback of the flame to within the burner B, as is always potentially the case with known premixing sections and against which a remedy is sought by means of complicated flame holders. If the combustion air is preheated, which is always the case with a formation of the mixture using recirculated exhaust gas, accelerated overall evaporation of the liquid fuel 12 takes place before the ignition location is reached at the outlet of the burner B. The degree of evaporation of the fuel depends, of course, on the size of the burner B, on the droplet size of the injected fuel and on the temperature of the combustion airflows. Minimized pollutant emission figures can be achieved if complete evaporation of the fuel takes place before the mixture enters the combustion zone. The same applies if the excess air is replaced by recirculated exhaust gas in near-stoichiometric operation. The width of the tangential inlet slots 19, 20 has an effect on the desired flow field of the air with its reverse flow zone 6 in the region of the burner outlet. It may be generally stated that a reduction of the width of the tangential inlet slots 19, 20 displaces the reverse flow zone 6 further upstream so that the mixture than, logically, ignites earlier. It should, however, be stated that once the reverse flow zone 6 has been fixed, its position is intrinsically stable because the swirl rate increases in the flow direction in the region of the conical shape of the burner B. The axial velocity of the mixture can than be influenced by corresponding physical properties of the axially introduced combustion air 15*a*. As may be clearly seen from FIGS. 8–10, the width of the tangential inlet slots 19, 20 can be established by a corresponding mechanical device constructed with a releasable connection and acting between the two bodies 1, 2. By means of such a measure, not shown in the figure, adjustment of the tangential inlet slots can also be undertaken during operation.

The actual geometric configuration of the guide plates 21*a*, 21*b* may be seen from FIGS. 8–10. They have flow introduction functions and, depending on their length, they lengthen the respective end of the bodies 1, 2 in the inlet flow direction of the combustion air 15. The guidance of the combustion air 15 into the hollow conical space 14 can be optimized by opening or closing the guide plates 21*a*, 21*b* around a center of rotation 23 placed in the region of the tangential inlet slots 19, 20. This is particularly necessary when the original width of the tangential inlet slots 19, 20 is altered in accordance with the above considerations. The burner B can also, of course, be operated without guide plates 21*a*, 21*b* or other similar aid can be provided for this purpose.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the U.S. is:

1. A method for operating a combustion chamber of a gas turbine to minimize $NO_x$ emissions, the combustion chamber being equipped with a plurality of premixing burners which are arranged as a plurality of separately controllable groups, at least one group being equipped with controllable premixing burners, the method comprising the steps of:

operating one group of burners as piloting burners; and activating and operating as piloted burners additional burner groups cumulatively to control a load output of the combustion chamber;

wherein, at part load, output is controlled by distributing a fuel supply between said pilot burner group and one of said piloted burner groups responsive to ambient conditions and a load output requirement of the combustion chamber;

wherein, at full load, output is controlled by distributing a fuel supply between said pilot burner group and one of said piloted burner groups responsive to ambient conditions; and wherein said piloted burner groups are operated with a richer fuel mixture when the load output is being decreased than when the load output is being increased.

2. The method as claimed in claim 1, wherein the fuel supply is distributed responsive to at least one of an ambient temperature and an ambient pressure.

* * * * *